US008112237B2

(12) United States Patent
Bartonek

(10) Patent No.: US 8,112,237 B2
(45) Date of Patent: Feb. 7, 2012

(54) SYSTEM AND METHOD FOR CORRECTING SIGNAL POLARITIES AND DETECTION THRESHOLDS IN A RAIL VEHICLE INSPECTION SYSTEM

(75) Inventor: Mark Bartonek, Blue Springs, MO (US)

(73) Assignee: Progress Rail Services Corp., Albertville, AL (US)

( * ) Notice: Subject to any disclaimer, the term of this patent is extended or adjusted under 35 U.S.C. 154(b) by 406 days.

(21) Appl. No.: 12/402,021

(22) Filed: Mar. 11, 2009

(65) Prior Publication Data

US 2010/0235123 A1 Sep. 16, 2010

(51) Int. Cl.
*G06F 15/00* (2006.01)
*G01N 29/04* (2006.01)

(52) U.S. Cl. ..... 702/66; 73/636

(58) Field of Classification Search ..... 702/35, 702/66, 184; 701/29, 117; 73/636
See application file for complete search history.

(56) References Cited

U.S. PATENT DOCUMENTS

| | | | | |
|---|---|---|---|---|
| 3,402,290 | A | 9/1968 | Blackstone et al. | |
| 3,629,572 | A | 12/1971 | Gallagher | |
| 3,646,343 | A | 2/1972 | Caulier et al. | |
| 3,697,744 | A | 10/1972 | Howell | |
| 3,731,087 | A | 5/1973 | King | |
| 3,812,343 | A | 5/1974 | Gallagher et al. | |
| 3,872,456 | A | 3/1975 | Glazar | |
| 3,941,338 | A * | 3/1976 | Knudsen | 246/77 |
| 4,068,811 | A | 1/1978 | Caulier | |
| 4,313,583 | A | 2/1982 | Bambara et al. | |
| 4,340,886 | A | 7/1982 | Boldt et al. | |
| 4,443,119 | A | 4/1984 | Snider, Jr. et al. | |
| 4,491,290 | A | 1/1985 | Douglas | |
| 4,501,006 | A | 2/1985 | Korenberg | |
| 4,659,043 | A | 4/1987 | Gallagher | |
| 4,805,854 | A | 2/1989 | Howell | |
| 4,928,910 | A | 5/1990 | Utterback et al. | |
| 4,974,797 | A | 12/1990 | Myers et al. | |
| 5,060,890 | A | 10/1991 | Utterback et al. | |
| 5,100,243 | A | 3/1992 | Grosskopf et al. | |
| 5,149,025 | A | 9/1992 | Utterback et al. | |

(Continued)

FOREIGN PATENT DOCUMENTS

DE 4325018 3/1994

(Continued)

OTHER PUBLICATIONS 8-bit Microcontroller with 2/4/8K Bytes In-System Programmable Flash, 2586KS-AVR-01/08, © 2008 Atmel Corporation, www.atmel.com, 28 pgs.

(Continued)

*Primary Examiner* — Bryan Bui
(74) *Attorney, Agent, or Firm* — Finnegan, Henderson, Farabow, Garrett & Dunner LLP; Christopher R. Carroll

(57) ABSTRACT

A method for identifying a location of a wheel of a rail vehicle includes producing a first signal representative of a potential difference between leads electrically coupled with a wheel gate transducer and modifying the first signal that is received over a first channel to produce a second signal over a second channel, where the second signal differs from the first signal. The method further includes monitoring the first and second signals over the first and second channels to identify the location of the wheel relative to the wheel gate transducer.

21 Claims, 5 Drawing Sheets

U.S. PATENT DOCUMENTS

| | | | | |
|---|---|---|---|---|
| 5,201,483 | A | 4/1993 | Sutnar et al. | |
| 5,331,311 | A | 7/1994 | Doctor | |
| 5,381,700 | A | 1/1995 | Grosskopf, Jr. | |
| 5,429,329 | A | 7/1995 | Swanson | |
| 5,446,451 | A | 8/1995 | Grosskopf, Jr. | |
| 5,446,452 | A | 8/1995 | Litton | |
| 5,448,072 | A | 9/1995 | Gallagher | |
| 5,659,491 | A | 8/1997 | Ichikawa et al. | |
| 5,660,470 | A | 8/1997 | Mench | |
| 5,677,533 | A | 10/1997 | Yaktine et al. | |
| 5,734,579 | A | 3/1998 | Sakaguchi | |
| 6,100,964 | A | 8/2000 | De Cremiers | |
| 6,241,196 | B1 | 6/2001 | Steurer et al. | |
| 6,405,148 | B1 | 6/2002 | Hayashi et al. | |
| 6,523,411 | B1 | 2/2003 | Mian et al. | |
| 6,663,053 | B1 | 12/2003 | Shams | |
| 6,688,561 | B2 | 2/2004 | Mollet et al. | |
| 6,695,472 | B1 | 2/2004 | Nayer | |
| 6,813,581 | B1 | 11/2004 | Snyder | |
| 6,826,489 | B2 | 11/2004 | Scanlan et al. | |
| 6,872,945 | B2 | 3/2005 | Bartonek | |
| 6,881,951 | B2 | 4/2005 | Bartonek | |
| 6,911,914 | B2 | 6/2005 | Matherw, Jr. et al. | |
| 7,024,294 | B2 | 4/2006 | Sullivan et al. | |
| 7,026,609 | B2 | 4/2006 | Bartonek | |
| 7,139,668 | B2 | 11/2006 | Bechhoefer | |
| 7,140,577 | B2 | 11/2006 | Mollet et al. | |
| 7,415,771 | B2 | 8/2008 | Harrill | |
| 2002/0065610 | A1 * | 5/2002 | Clark et al. | 702/35 |
| 2002/0139191 | A1 | 10/2002 | Hedeen et al. | |
| 2003/0006655 | A1 | 1/2003 | Zhang | |
| 2003/0236598 | A1 | 12/2003 | Villarreal Antelo et al. | |
| 2005/0194497 | A1 | 9/2005 | Matzan | |
| 2006/0131464 | A1 | 6/2006 | Hesser et al. | |
| 2008/0228427 | A1 | 9/2008 | Church | |
| 2008/0281532 | A1 | 11/2008 | Church et al. | |
| 2008/0288170 | A1 | 11/2008 | Ruggiero | |
| 2009/0055043 | A1 * | 2/2009 | Mian et al. | 701/29 |

FOREIGN PATENT DOCUMENTS

| | | |
|---|---|---|
| DE | 4238151 | 5/1994 |

OTHER PUBLICATIONS 8-bit Microcontroller with 2/4/8K Bytes In-System Programmable Flash, Preliminary, © 2008 Atmel Corporation, www.atmel.com, 231 pgs.

Füs II Detector, GE Transportation, 2009.General Electric Company, 2 pgs.

Micro Talker, GE Transportation, 2009 General Electric Company, 3 pgs.

Micro Hot Bearing Detector (HBD), 2009 General Electric Company, 2 pgs.

PCT/US2008/060521; filed Apr. 16, 2008; International Search Report; 4 pgs.

PCT/US2008/061897; filed Apr. 29, 2008; International Search Report; 4 pgs.

PCT/US2007/086748; filed Dec. 7, 2007; International Search Report; 4 pgs.

Knoll, et al., "Entwicklung Eines Checkpointprototypen bei der OEBB Infrastruktur Betrieb AG"; Signal + Draht; Telzlaff Verlag GmbH, Darmstadt, DE; Jul. 1, 2006, pp. 10-14; XP001244502, ISSN 0037-4997.

Wolfberg, et al., "Der Fracas-Prozess—Felddatenerfassung und Verfuegbarkeitsoptimierung"; Signal + Draht; Telzlaff Verlag GmbH, Darmstadt, DE; vol. 93, No. 10, Oct. 2001, pp. 25-29, XP001082215, ISSN 0037-4997.

Next Generation Defect Detector, from http://web.archive.org/web/20080704123654/http://www.southern-tech.com/products/dds.aspx, available Jul. 4, 2008, one page.

Magnetic Transducer, from http://web.archive.org/web/20081006075304/http://www.southern-tech.com/products/Magnetic_Transducer.aspx, available Oct. 6, 2008, one page.

Type II—Bearing Scanner, from http://web.archive.org/web/20081006075244/http://www.southern-tech.com/products/smartscanng.aspx, available Oct. 6, 2008, one page.

Type II—Wheel Scanner, from http://web.archive.org/web/20081006075225/http://www.southern-tech.com/products/Wheel_Scanner.aspx, available Oct. 6, 2008, one page.

Atmel Products—Product Card, from http://www.atmel.com, dated Mar. 3, 2009, two pages.

* cited by examiner

SYSTEM AND METHOD FOR CORRECTING SIGNAL POLARITIES AND DETECTION THRESHOLDS IN A RAIL VEHICLE INSPECTION SYSTEM

BACKGROUND OF THE INVENTION

This invention relates generally to rail vehicle inspection systems.

Known rail vehicle inspection systems include transducers mounted to rails. Typically, at least two transducers are longitudinally spaced apart from one another along the rails. The transducers may each be referred to as a wheel gate. The space between the transducers may be referred to as an inspection window. When a rail vehicle such as a train passes through the wheel gate, the transducers determine when the wheels of the rail vehicle enter and exit the inspection window. The transducers determine when wheels are in the gate to permit detection systems to inspect the axles of the rail vehicle; to count the number of axles in the vehicle, to determine a speed of the vehicle, and the like. For example, in hot box detection systems, the transducers identify when wheels enter the inspection window, or heat detection window, so that the system can measure the thermal profiles of corresponding axle bearings. Some known transducers use a permanent magnet that provides a magnetic field. As wheels pass through the field, the wheels cause magnetic flux to vary, which induces an electric current in a coil of the transducer. The induced current is used to identify movement of the wheel relative to the transducers and into and out of the inspection window. The waveform of a signal representative of the current induced in the coil typically has a predominantly positive polarity and resembles a sine wave when a wheel/has passed the transducer. The waveform may be monitored to determine when the signal increases to a positive peak value and then falls below zero to determine when a zero crossing occurs. The occurrence of a zero crossing indicates that the wheel is located or centered over the transducer.

The transducers in known inspection systems may be incorrectly installed or wired. The terminals, leads or wires of a transducer may be inadvertently switched by operators who install the transducer. For example, the positive and negative wires of the transducer may be switched. The switched terminals may cause the waveform of the transducer signals to have a predominantly negative polarity and resemble cosine wave. The negative polarity signals may not accurately reflect the movement of wheels with respect to the transducer. For example, in contrast to the waveform of a positive polarity signal, the negative polarity waveform does not increase to a peak positive value or fall to a zero crossing. Additionally, the increase of the negative polarity waveform upward toward zero may be incorrectly identified as a wheel approaching the transducer. As a result, an incorrectly wired or installed transducer may be unable to accurately identify the location of a wheel relative to a transducer and the entry or exit of a wheel into the inspection window. Incorrect identifications of wheels entering and exiting into wheel gates may result in inaccurate axle counts or missed hot boxes, for example.

Thus, a need exists for a method and system to correct for signals obtained from incorrectly or improperly installed transducers. Such systems and method may improve accuracy in identifying when a wheel of a rail vehicle enters and exits a wheel gate, thereby providing more accurate inspections of axles, counts of axles in a rail vehicle, and the like.

BRIEF DESCRIPTION OF THE INVENTION

In one embodiment, a method for identifying a location of a wheel of a train or other rail vehicle is provided. The method includes producing a first signal representative of a potential difference between leads electrically coupled with a wheel gate transducer and modifying the first signal that is received over a first channel to produce a second signal over a second channel, where the second signal differs from the first signal. The method further includes monitoring the first and second signals over the first and second channels to identify the location of the wheel relative, to the wheel gate transducer.

In another embodiment, a rail vehicle inspection system is provided. The system includes a wheel gate transducer and a gate circuit. The wheel gate transducer generates a potential difference based on movement of a wheel of a rail vehicle relative to the wheel gate transducer. The gate circuit is coupled with the wheel gate transducer and includes a microcontroller. The gate circuit receives the potential difference to produce a first signal representative of the potential difference over a first channel and to modify the first signal to produce a second signal over a second channel. The microcontroller is configured to monitor the first and second signals over the first and second channels to identify a location of the wheel relative to the wheel gate transducer.

In another embodiment, a computer readable storage medium for a wheel detection system having a wheel gate transducer and a gate circuit including a microcontroller is provided. The computer readable storage medium includes instructions to direct the gate circuit to produce a first signal representative of a potential difference between leads electrically coupled with the wheel gate transducer and to modify the first signal received over a first channel to produce a second signal over a second channel, where the second signal differs from the first signal. The computer readable storage medium also includes instructions to direct the microcontroller to monitor the first and second signals over the first and second channels to identify the location of the wheel relative to the wheel gate transducer.

DETAILED DESCRIPTION OF THE INVENTION

Figure 1:
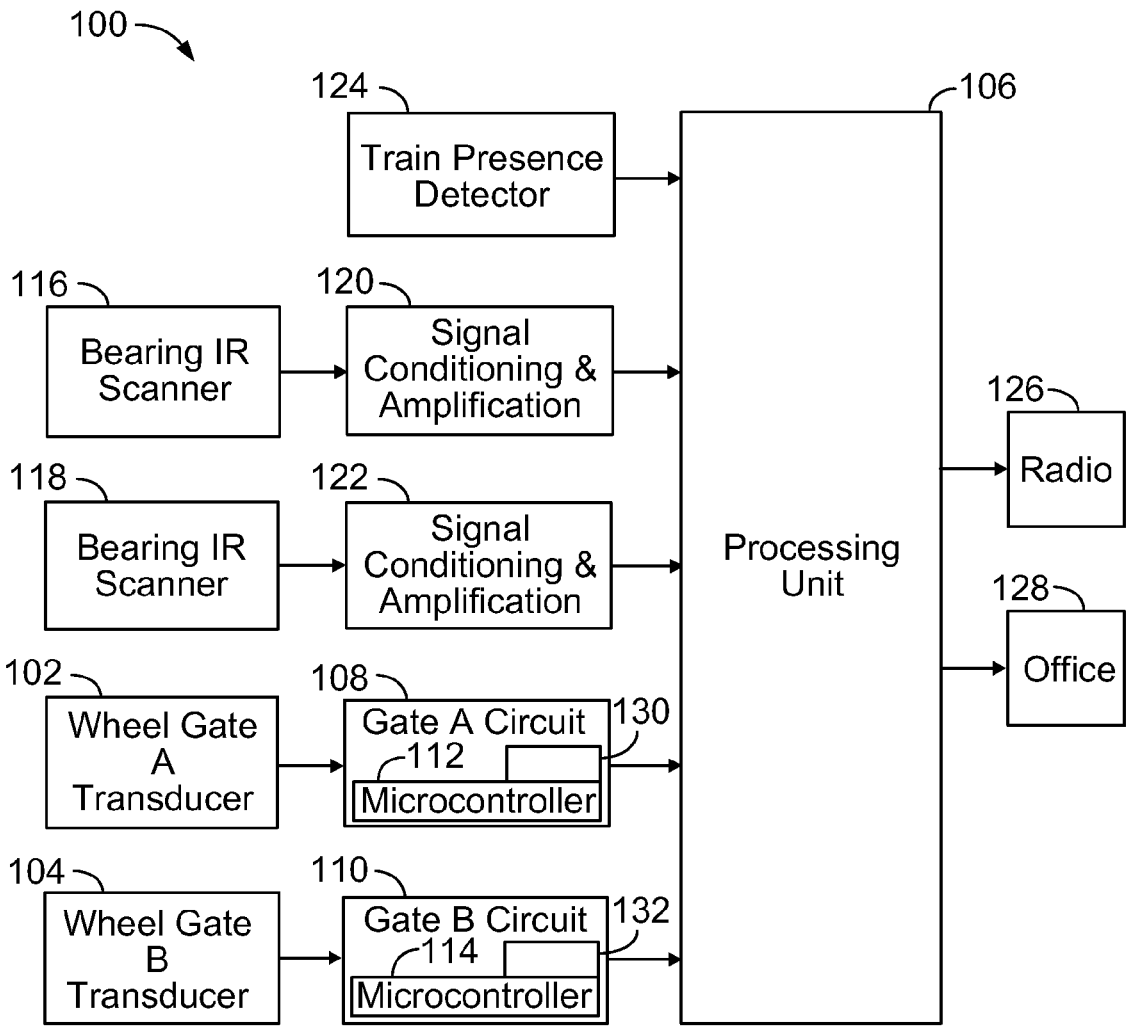
FIG. 1 is a schematic illustration of a rail vehicle inspection system in accordance with one embodiment.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It should be noted that although one or more embodiments may be described in connection with rail vehicle inspection systems, the embodiments described herein are not limited to trains. In particular, one or more embodiments may be implemented in connection with different types of rail vehicles (e.g., a vehicle that travels on one or more rails, such as single locomotives and railcars, powered and un-powered ore carts and other mining vehicles, light rail transit vehicles, and the like) and other vehicles, including, by way of example only, automobiles. Example embodiments of systems and methods for automatically correcting for the reversed polarity of signals obtained from an improperly or incorrectly wired wheel gate transducer are provided. At least one technical effect described herein includes a method and system that provides increased accuracy in identifying when wheels of a rail vehicle enter and exit wheel gates.

FIG. 1 is a schematic illustration of a rail vehicle inspection system 100 in accordance with one embodiment. The system 100 detects entry and exit of wheels of the vehicle, and thus axles and axle bearings, into an inspection window. The system 100 includes a wheel "Gate A" transducer 102 and a wheel "Gate B" transducer 104. The transducers 102, 104 are joined to a rail or railroad track (not shown) and communicatively coupled with a processing unit 106 through corresponding Gate A and Gate B circuits 108, 110. The Gate A transducer 102 is longitudinally spaced apart from the Gate B transducer 104 along the rails. In one embodiment, the Gate A and Gate B transducers 102, 104 are longitudinally separated from one another by approximately twenty-four inches, or approximately 60.96 centimeters. Each of the transducers 102, 104 may be referred to as a wheel gate. An inspection window or heat detection window may be defined as the space between the transducers 102, 104. The transducers 102, 104 detect when a wheel of a vehicle enters and exits into the inspection window from either direction along the rails. In a train moving in one direction along the rails, the Gate A transducer 102 is referred to as the "gate on" transducer and the Gate B transducer 104 is the "gate off" transducer. In a train moving in an opposite direction, the opposite is true: the Gate B transducer 104 is referred to as the "gate on" transducer while the Gate A transducer 102 is the "gate off" transducer.

In one embodiment, the wheel transducers 102, 104 use magnetic fields to sense movement of a wheel into and put of the wheel gate. As a wheel passes near a permanent magnet and coil of a transducer 102, 104, a magnetic flux is created by the moving wheel. The magnetic flux induces an electric current in the coil. The induced current is used to identify a location or position of a wheel with respect to the corresponding transducer 102, 104. The transducers 102, 104 generate analog signals that are representative of the position of the wheel. The analog signals are communicated to the Gate A and B circuits 108, 110, respectively. The Gate A and B circuits 108, 110 convert the analog signals to digital signals that are communicated to the processing unit 106. As described below, the Gate A and B circuits 108, 110 include microcontrollers 112, 114 that may automatically correct for the polarity of signals obtained from an incorrectly wired gate transducer 102, 104. Additionally, the microcontrollers 112, 114 may determine if the signals sensed by the wheel transducer 102, 104 are caused by a wheel or by another object.

The processing unit 106 and microcontrollers 112, 114 may include circuits for fetching, interpreting, and/or executing instructions that are stored in local or remote memories, whether volatile or nonvolatile. For example, the microcontrollers 112, 114 and/or Gate A and Gate B circuits 108, 110 may include memories 130, 132. Alternatively, one or more of the memories 130, 132 may be located in the processing unit 106. In one embodiment, the microcontrollers 112, 114 include ATtiny45 microcontrollers manufactured by Amtel®. One or more of the processing unit 106 and microcontrollers 112, 114 include a program counter, an instruction decoder, an arithmetic logic unit, and accumulators. Computer programs, or software, are stored in memory storage units. A suitable memory storage unit used in the preferred embodiment is an electrically erasable programmable read only memory (EEPROM). Moreover, it is understood that other types of memory units could be utilized, such as simple read only memory (ROM), or programmable read only memory (PROM), or, if the ability to reprogram the ROM is desirable, erasable programmable read only memory (EPROM), which are conventionally erased by exposure to ultraviolet light or FLASH memory.

The Gate A and B transducers 102, 104 are used to identify when wheels are located in the inspection window. Based on this information, the Gate A, B circuits 108, 110 and/or processing unit 106 may count the number of axles in a rail vehicle, determine the speed of the vehicle, and/or direct one or more devices to examine the wheels or bearings. For example, infrared (IR) bearing scanners 116, 118 may scan the bearings of train axles when the corresponding wheels are located using the wheel transducers 102, 104. In order to identify the location of the axle bearings in the inspection window, the processing unit 106 relies on the wheel transducers 102, 104 to determine when wheels, and thus an axle, enter the inspection window and to accurately count the wheels and locate particular axles.

The system 100 may include signal conditioning and amplification units 120, 122 that are coupled to and receive signals from the bearing scanners 116, 118. The units 120, 122 condition and amplify the voltage component of the signal transmitted from the bearing scanners 116, 118. The analog signals generated by the units 120, 122 are transmitted to the processing unit 106. The system 100 also includes a rail vehicle presence detector 124 that determines when a rail vehicle is approaching the system 100. The processing unit 106 may energize or de-energize one or more components of the system 100 based upon the state of the rail vehicle presence detector 124. The system 100 transmits information generated by the processing unit 106 to a radio 126 and/or a remote office 128. For example, a warning indication may be transmitted to the radio 126 in order to audibly announce a hot box, or overheated axle bearing. Information such as axle counts, vehicle summary data, detailed vehicle data, bearing profiles, warnings, vehicle speed data, and alarm information may be communicated to the remote office 128.

Figure 2:
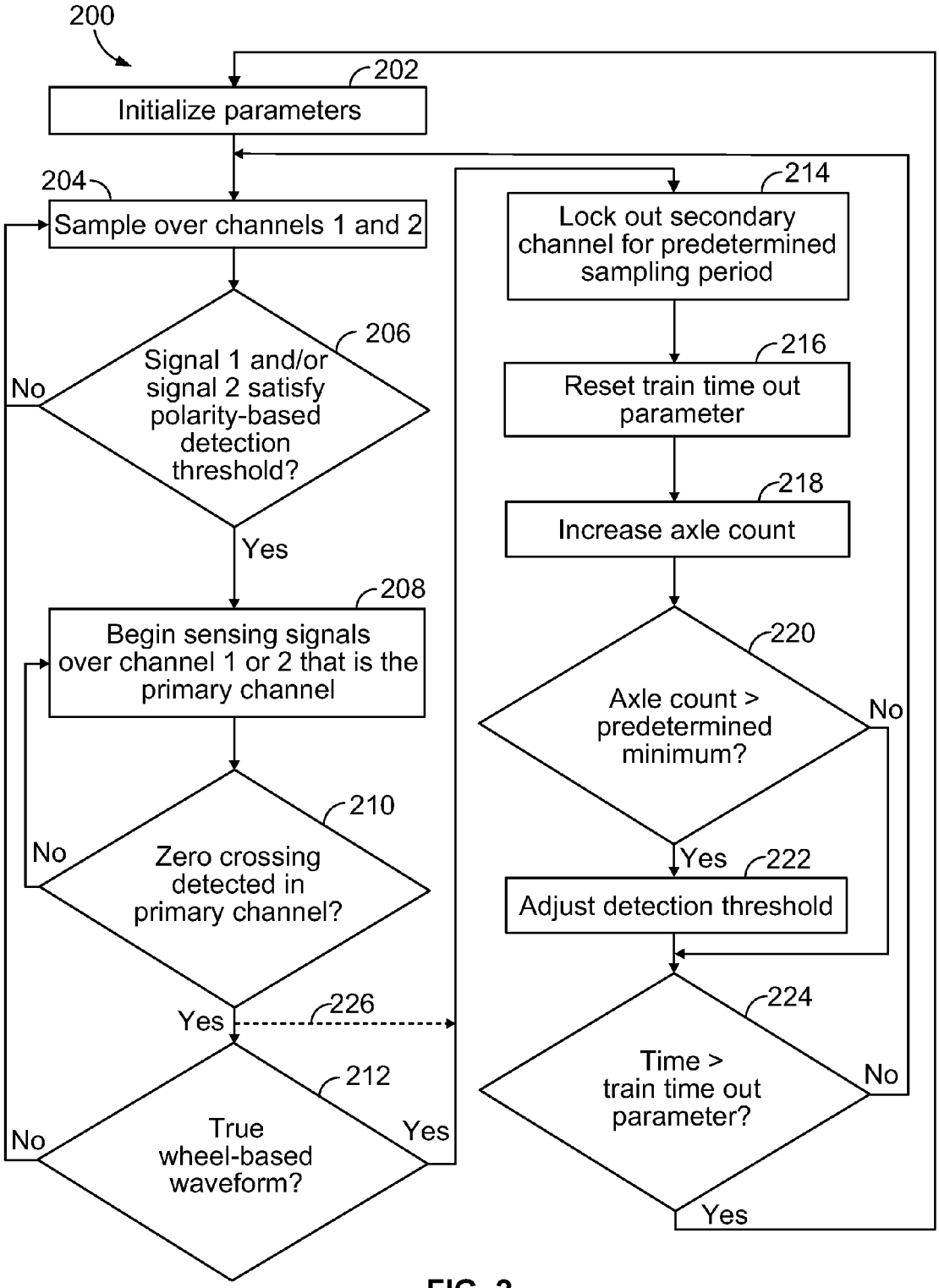
FIG. 2 illustrates a flowchart of a process for detecting a wheel in accordance with one embodiment.

FIG. 2 illustrates a flowchart of a process 200 for detecting a wheel in accordance with one embodiment. The process 200 examines analog signals generated by the wheel gate transducers 102, 104 (shown in FIG. 1) to determine if a wheel of a rail vehicle has entered or exited the inspection window. While the discussion herein focuses on the transducer 102, the discussion may equally apply to the transducer 104. One or more of the operations described in connection with the process 200 may be carried out using the microcontrollers 112, 114 (shown in FIG. 1) that correspond with the transducers 102, 104.

At 202, several parameters of the process 200 are initialized. The parameters include a rail vehicle presence parameter, a wheel presence parameter, a vehicle time out parameter, a polarity-based detection threshold, and an axle count. The rail vehicle presence parameter indicates whether a rail vehicle is currently passing through the gate. For example, the rail vehicle presence parameter has a value of zero when no train is passing through the gate and has a value of one when a train is passing through the gate. The wheel presence parameter indicates whether a wheel is in the inspection window. The wheel presence parameter may have a value of zero when no wheel is in the inspection window and a value of one when a wheel is in the inspection window. The vehicle time out parameter is a predetermined maximum amount of time that is permitted to elapse between wheels before the process 200 declares that the rail vehicle has finished passing the transducer 102 (shown in FIG. 1). A counter or clock may track the elapsed amount of time since the previous wheel was detected. If the elapsed time reaches the vehicle time out parameter, then the process 200 determines that the vehicle has finished passing the transducer 102. The detection threshold is described below. The axle count is a measurement of the number of axles counted by the process 200 for a particular vehicle. Several of the parameters, including the rail vehicle and wheel presence parameters, and the axle count parameter are initialized at 202 by setting the values of these parameters to zero or another predetermined value. The detection threshold may be initialized by setting the value of this parameter to a predetermined amount.

At 204, signals representative of the potential difference sensed by the transducer 102 (shown in FIG. 1) are produced and sampled over first and second channels. For example, the Gate A circuit 108 (shown in FIG. 1) may produce a first signal that represents the potential difference across the coil in the transducer 102. The Gate A Circuit 108 modifies the first signal to create a second signal that is different from the first signal. In one embodiment, the second signal is the inverse of the first signal. For example, the second signal may be an inverted version of first signal. If the first signal has a predominantly positive polarity, such as a sine wave, then the second signal may have a predominantly negative polarity, such as a cosine wave. Alternatively, if the first signal has a negative polarity, then the second signal may have a positive polarity. When a wheel passes by the transducer 102, inverting the first signal to create the second signal provides the Gate A circuit 108 with a positive polarity signal and a negative polarity signal, regardless of whether the transducer 102 was properly installed and wired. As described below, the first and second signals may be compared to a polarity-based detection threshold in order to determine which of the first and second signals is a positive polarity signal.

The first and second, signals are sampled over different channels. For example, the first signal may be communicated to the microcontroller 112 (shown in FIG. 1) over a first channel and, the second signal may be communicated over a second channel. The first and second signals may be sampled over the first and second channels at a predetermined initial sampling rate. In one embodiment, the first and second signals are each sampled by the microcontroller 112 at a rate of 3 kHz. Alternatively, a different sampling rate may be used. Additionally, the first and second signals may be sampled at different rates.

Figure 3:
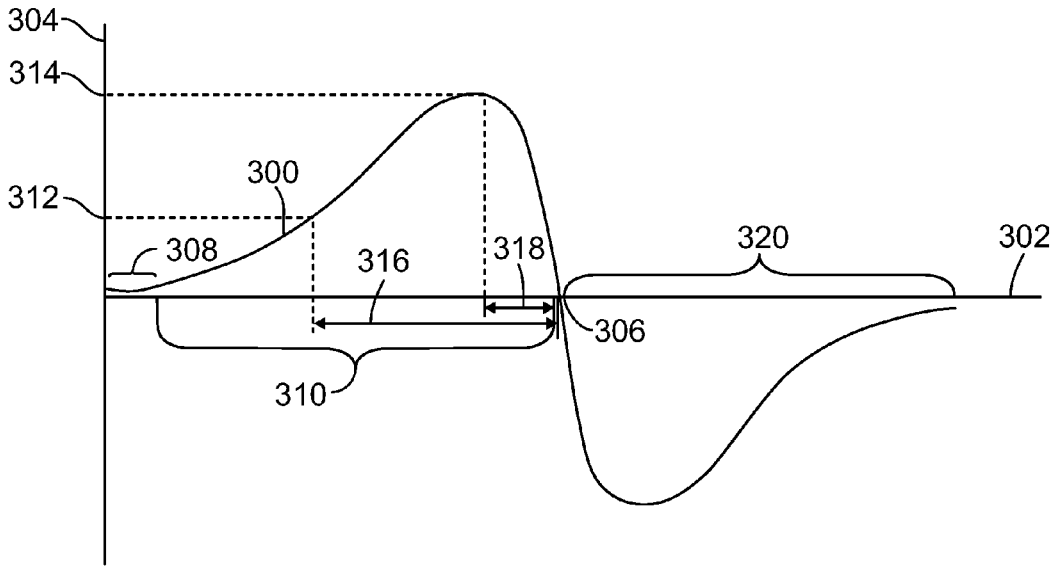
FIG. 3 is a graphical illustration of a typical signal sampled over a channel from a wheel gate transducer (such as is shown in FIG. 1) in accordance with one embodiment.
Figure 4:
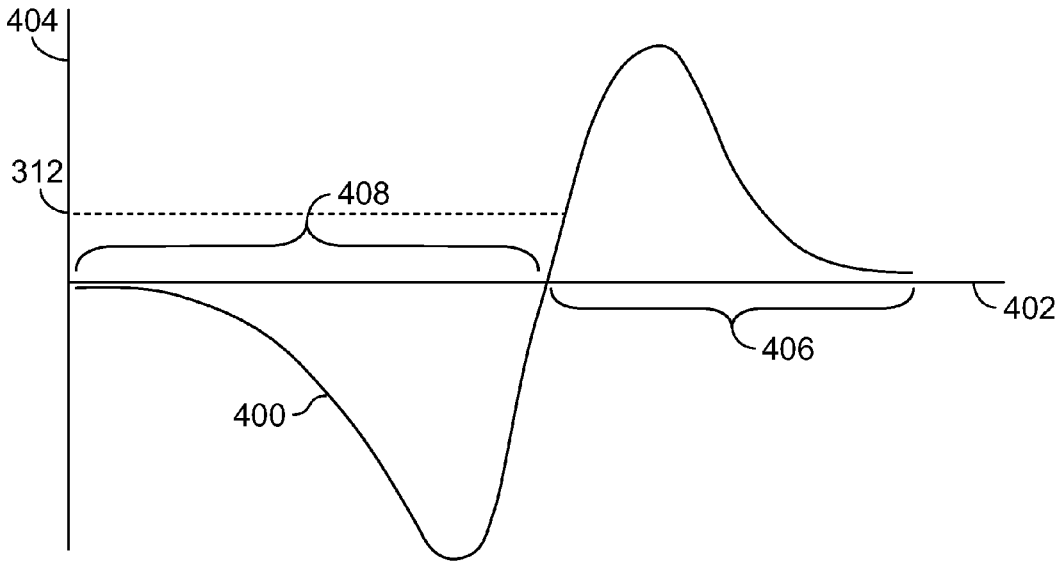
FIG. 4 is a graphical illustration of a signal sampled over a different channel from the same wheel gate transducer (shown in FIG. 1) in accordance with one embodiment.

FIG. 3 is a graphical illustration of a first signal 300 sampled over the first channel in accordance with one embodiment. FIG. 4 is a graphical illustration of a second signal 400 sampled over the second channel in accordance with one embodiment. The signals 300, 400 are shown alongside horizontal axes 302, 402 and vertical axes 304, 404, respectively. The horizontal axes 302, 402 are representative of time or distance and the vertical axes 304, 404 are indicative of the magnitude of the signals 300, 400. In one embodiment, the first signal 300 represents a typical signal that is produced by the transducer 102 (shown in FIG. 1) when a single wheel passes the transducer 102 and the second signal 400 is the inverted version of the signal 300. Alternatively, the second signal 400 may be the signal produced by the transducer 102 and the first signal 300 is the inverted version of the second signal 400. The Gate A circuit 108 (shown in FIG. 1) may include one or more filtering elements or components that filter out components of the signal 300 and/or the signal 400. For example, the Gate A circuit 108 may include filters that limit negative portions 320, 408 of the signals 300, 400 to a maximum amount, such as −0.3 Volts.

The first signal 300 may be used to identify a location of a wheel or axle and a time at which the wheel is located in a wheel gate. Prior to the wheel entering the wheel gate, the signal 300 is approximately zero during a pre-gate portion 308 of the signal 300. During the pre-gate portion 308, the signal 300 may be slightly biased above, or below the horizontal axis 302 due to noise in the signal 300. The signal 300 increases in magnitude as the wheel approaches the transducer 102 (shown in FIG. 1). The increase in the signal 300 during a gate-approaching portion 310 reflects the increased interference between the wheel and the magnetic field proximate the transducer 102. During the gate-approaching portion 310, the signal 300 reaches a peak 314 before decreasing at a relatively rapid rate toward the horizontal axis 302. In one embodiment, the point at which the signal 300 crosses the horizontal axis 302 is referred to as a zero crossing 306. The zero crossing 306 is used to identify a point in time when the wheel is located or centered over the transducer 102 and may be used to determine a location of the wheel and/or corresponding axle.

Referring again to the process 200 in FIG. 2, at 206, the first and second signals are compared to a polarity-based detection threshold 312. Alternatively, the detection threshold 312 may have a negative value. The detection threshold 312 is compared to the first and second signals to determine if a wheel is detected and to identify a polarity of the respective first and second signals. For example, the detection threshold 312 may have a positive value that is compared to the first and second signals to determine if either of the first and second signals exceeds the detection threshold 312. If the first or second signal exceeds the detection threshold 312, then the corresponding first or second signal may indicate the presence of a wheel near the transducer 102 (shown in FIG. 1) and that the corresponding first or second signal has a positive polarity.

The detection threshold 312 may filter out noise in the first and second channels. For example, the first and/or second signals may fluctuate due to noise in the system 100 (shown in FIG. 1) even when no wheel is sensed or detected by the transducer 102 (shown in FIG. 1). Ignoring the first and second signals until at least one of the first and second signals exceeds the detection threshold 312 may prevent noise in the first and second signals from being identified as a valid wheel gate.

The first and second signals are monitored until at least one of the first and second signals exceeds the detection threshold 312. For example, if neither the first nor the second signal has exceeded the detection threshold 312, the first and second signals may indicate that no wheel is approaching the wheel gate and the process 200 returns to 204 where additional sampling of the first and second signals continues. Alternatively, if the first or second signal does exceed the detection threshold 312, the corresponding signal may indicate that a wheel is approaching the transducer 102 (shown in FIG. 1). In one embodiment, the first in time of the first and second signals to exceed the detection threshold 312 is used to identify the entrance of a wheel into the gate independent of the other of the first and second signals. For example, if the first signal exceeds the detection threshold 312 before the second signal, the first signal may be used to identify the location of the wheel with respect to the transducer 102 (shown in FIG. 1) and without regard to the second signal. Once one of the first and second signals exceeds the detection threshold 312, the corresponding one of the first and second channels is designated as a primary channel while the other channel is designated as a secondary channel. Thus, in the illustrated embodiment, the first channel is designated as the Primary Channel because the first signals 300 exceed the detection threshold 312 before the second signals 400 and the second channel is designated as the Secondary Channel. The Primary Channel signals are used to identify a location of a wheel with respect to the transducer 102 without regard to the Secondary Channel signals. Once at least one of the first and second signals exceeds the detection threshold 312, the value of the wheel presence parameter is adjusted. For example, the value of the wheel presence parameter may be changed from zero to one to indicate the presence of a wheel hear the transducer 102.

At 208, signals are sensed or monitored over the Primary Channel. For example, the signals 300 are sampled over the Primary Channel in order to identify the location of the wheel with respect to the wheel gate. The signals 400 that were being sampled over the Secondary Channel are ignored or neglected. The sampling rate of the Primary Channel may be increased to improve the resolution of the system 100 for rail vehicles travelling at higher speeds. For example, once a wheel is detected by the transducer 102 (shown in FIG. 1), the microcontroller 112 (shown in FIG. 1) may sample at an increased rate in order to more accurately identify positions of the wheels of a moving train. The increased sampling fate may be required in order to locate the wheels of vehicles moving at relatively high speeds such as, for example, 150 miles per hour (241 kilometers per hour). In one embodiment, if the signals 300, 400 were both sampled at 3 kHz over the first and second channels, respectively, then the Primary Channel may be sampled at a rate of 6 kHz after the Secondary Channel are locked out, or ignored.

At 210, the Primary Channel signals 300 are examined to determine if a zero crossing 306 has occurred. For example, the signals 300 may be sampled at the increased sampling rate until the signals 300 fall below the horizontal axis 302. Alternatively, the signals 300 are sampled until the signals 300 decrease below a predetermined zero crossing threshold. The zero crossing threshold may have a value different from zero. For example, the zero crossing threshold may be approximately 0.06 Volts. A decrease in the signal 300 below the zero crossing threshold may indicate that the wheel is located or centered over the corresponding wheel gate transducer 102, 104 (shown in FIG. 1). The process 200 continues to examine the Primary Channel signals 300 until a zero crossing 306 occurs or until the signal 300 falls below the zero crossing threshold.

In one embodiment, at 212, a wheel verification test is performed. Alternatively, the wheel verification test is not performed and the process 200 bypasses 212 along a path 226. During the wheel verification test, the Primary Channel signals 300 are examined to determine if the signals 300 are representative of movement of a wheel or a different object. The waveform of the signals 300 may be representative of movement of a wheel if the waveform of the signals 300 is shaped similar to a rightward leaning sine wave, as shown in FIG. 3. The waveform of signals that are representative of movement of an object other than a wheel may not have the rightward leaning shape. For example, the waveform of signals representative of a dangling chain may have a more symmetric shape on opposite sides of the waveform peak.

In order to identify the Primary Channel signals 300 as being representative of wheel movement, the waveform peak 314 of the signals 300 is identified. The peak 314 is the maximum signal strength of the Primary Channel signal 300 that occurs between the time at which the signals 300 exceed the detection threshold 312 and the time at which the zero crossing 306 occurs or the signal 300 falls below the zero crossing threshold. Two sampling periods 316, 318 are derived. The first sampling period 316 is the period beginning at the point in time that the Primary Channel signals 300 exceeded the detection threshold 312 and ending at the zero crossing 306 or time that the signals 300 fell below the zero crossing threshold. The second sampling period 318 is the period beginning at the time at which the peak 314 occurs and ending at the zero crossing 306 or zero crossing threshold. The sampling periods 316, 318 may be measured as the number of times the Primary Channel signal 300 is sampled during each period 316, 318 or as the time that elapsed during each time period.

The first and second sampling periods 316, 318 are compared to determine if the waveform is representative of a moving wheel. For example, if the ratio of the second sampling period 318 to the first sampling period 316 exceeds a predetermined value of a wheel waveform parameter, then the ratio indicates that the waveform of the Primary Channel signal 300 is rightward leaning and represents a moving wheel. Alternatively, if the ratio does not exceed the threshold, then the Primary Channel signal 300 is indicative of an object other than a moving wheel. In one embodiment, the wheel waveform parameter has a value of at least 2.4. Optionally, a different value is used. If the ratio of the second sampling period 318 to the first sampling period 316 does not exceed the waveform threshold, then the process 200 returns to 204 where additional signals are sampled over Channels 1 and 2. Alternatively, if the ratio does exceed the threshold, then the flow of the process 200 continues to 214.

At 214, the Secondary Channel signals 400 continue to be locked out, or ignored, for a predetermined lockout period after the zero crossing 306 occurs (or the signal 300 falls below the zero crossing threshold). Locking out the Secondary Channel signals 400 may prevent the signals 400 from being identified as a wheel passing the transducer 102 (shown in FIG. 1). For example, as shown in FIG. 4, the Secondary Channel signal 400 includes a positive portion 406 that follows the negative portion 408. The positive portion 406 decreases toward the horizontal axis 402 and may cross the horizontal axis 402. If the positive portion 406 crosses the horizontal axis 402 or decreases below the zero crossing threshold, then the positive portion 406 might be counted as a wheel located over or centered on the transducer 102. In order to prevent the positive portion 406 from being identified as an additional wheel approaching the transducer 102, the process 200 locks out or ignores the Secondary Channel signal 400 for the lockout period. In one embodiment, the lockout period is a function of the first sampling period 316. For example, the lockout period may be 2.5 times the first sampling period 316. Alternatively, the lockout period may be a different fraction or multiple of the first sampling period 316. Continuing to ignore the Secondary Channel signals 400 for the lockout period may permit the signals 400 to return to an approximately constant magnitude or to a steady state below the detection threshold 312 before beginning to sense signals over the Secondary Channel again.

At 216, the clock or counter that is tracking the time that has elapsed since the last wheel was detected is reset. For example, a clock or counter in the microcontroller 112 (shown in FIG. 1) that counts up to the vehicle time out parameter may be reset.

At 218, the value of the axle count parameter is incrementally increased. For example, after identifying a wheel as entering the wheel gate, the axle count is increased by one. The axle count maintains a current count on the number of axles in a rail vehicle passing through the gate. Additionally, the axle count may be used to identify an axle identified as defective by the bearing scanners 116, 118 (shown in FIG. 1). If the 21st axle identified as entering the gate is found to have a journal bearing with an abnormally high temperature, the axle count may be communicated to the radio 126 (shown in FIG. 1) and/or office 128 (shown in FIG. 1) to warn an operator of the overheated axle bearing.

At 220, the axle count is compared to a predetermined axle minimum to determine if the detection threshold 312 is to be adjusted. The predetermined axle minimum is the number of axles that is counted before the detection threshold 312 is adjusted. The axle minimum establishes a minimum number of data points that is collected before the detection threshold 312 is modified. In one embodiment, the value of the axle minimum is four. Alternatively, the axle minimum is a different value.

At 222, if the axle count exceeds the axle minimum, then the detection threshold 312 is modified based on a moving average of the estimated vehicle speed. On the other hand, if the axle count does not exceed the axle minimum, then the detection threshold 312 is not adjusted based on the vehicle speed. In one embodiment, the detection threshold 312 is based on a speed calculated using a moving average of at least four axles. Once a minimum of at least four axles are identified by the process 200, the detection threshold 312 may be adjusted based on the average vehicle speed calculated based on the four axles. Alternatively, a different number of minimum axles may be used. The detection threshold 312 may continue to be adjusted based on additional identified axles.

The detection threshold 312 may need to be adjusted due to increased noise in the signals 300, 400 with increasing vehicle speed. The detection threshold 312 is increased to prevent false positive identifications of wheel entries into the gate. If the noise of the signals 300, 400 is sufficiently large, the noise may surpass the detection threshold 312 and be identified as a wheel entering the gate. Increasing the detection threshold 312 with the speed reduces the risk that noise in the signals 300, 400 will be identified as a wheel. Increasing the detection threshold 312 also may reduce the risk that signals 300, 400 obtained from a single, flat wheel (or a wheel having a partially flattened edge) is counted as two wheels passing the transducer 102 (shown in FIG. 1) in rapid succession.

As described above, the speed of the rail vehicle may be calculated using the first sampling period 316. Alternatively, the speed may be obtained using one or more other sensors or devices communicatively coupled with the system 100 (shown in FIG. 1). The new or adjusted detection threshold 312 is obtained from a look up table in one embodiment. For example, the detection threshold 312 may be adjusted based on the speed of the rail vehicle and Table #1 below.

TABLE #1

| Rail Vehicle Speed | New Detection Threshold |
|---|---|
| Less than 15 miles per hour (mph) (24.14 kilometers per hour (km/h) | 0.3 Volts (V) |
| 15 mph to 20 mph (24.14 km/h to 32.19 km/h) | 0.4 V |
| 20 mph to 30 mph (32.19 km/h to 48.28 km/h) | 0.75 V |
| 30 mph to 40 mph (48.28 km/h to 64.37 km/h) | 1.2 V |
| 40 mph to 50 mph (64.37 km/h to 80.47 km/h) | 1.6 V |
| 50 mph to 60 mph (80.47 km/h to 96.56 km/h) | 2.0 V |
| Greater than 60 mph (96.56 km/h) | 2.4 V |

The ranges of speed in each row include the larger of the two speeds. For example, the range 15 mph to 20 mph (24.14 km/h to 32.19 km/h) includes a train moving at 20 mph (32.19 km/h) while a train travelling greater than 20 mph (32.19 km/h) would fall within a different range in Table #1. The ranges of speed and detection threshold 312 shown in Table #1 are examples. Different ranges of speed and/or detection thresholds 312 may be used. Optionally, the new detection threshold 312 may be a function of the speed.

In one embodiment, the detection threshold 312 is dynamically adjusted based on the signals 300 sampled over the Primary Channel from a single transducer 102 (shown in FIG. 1). For example, rather than referring to signals 300 obtained using multiple transducers 102, 104 (shown in FIG. 1) to automatically adjust the detection threshold 312 based on speed of the rail vehicle, the detection threshold 312 is modified based on the signals 300 obtained using a single transducer 102 without regard to the signals 300 obtained using a different transducer 104.

At 224, a counter or clock that is tracking the amount of time since the previous wheel was identified is compared to the vehicle time out parameter. For example, the time measured by a clock or counter in the microcontroller 112 (shown in FIG. 1) since the previous wheel was detected is compared to the predetermined vehicle time out parameter. If the time measured by the microcontroller 112 is greater than the vehicle time out parameter, then the measured time may indicate that the vehicle has completely passed through the transducer 102 (shown in FIG. 1). Alternatively, if the measured time does not exceed the vehicle time out parameter, then the measured time may indicate that the vehicle has not fully passed by the transducer 102.

In one embodiment, the vehicle time out parameter is a predetermined time of ten seconds. Optionally, the vehicle time out parameter may be dynamically based on the speed of the vehicle passing through the gate. For example, an approximate speed of a train may be calculated by determining the number of samples obtained over a channel for the Primary Channel signal 300 during the first sampling period 316. The number of samples is multiplied by the sampling rate (e.g., 6 kHz) to determine a total time that elapsed during the first sampling period 316. A distance over which a wheel moved during the first sampling period 316 may be identified by referring to the distance along the horizontal axis 302 that is encompassed by the first sampling period 316. The distance may then be divided by the time to approximate a speed of the vehicle passing through the gate. This speed may be used in conjunction with a look up table stored in a memory (not shown) of the processing unit 106 (shown in FIG. 1) and/or microcontrollers 112, 114 (shown in FIG. 1) to change the vehicle time out parameter.

The process 200 returns to 202 to initialize the parameters for the next rail vehicle when the measured time exceeds the vehicle time out parameter and the vehicle is declared to have completely passed the transducer 102 (shown in FIG. 1). On the other hand, if the vehicle is still passing by the transducer 102, the process 200 returns to 204 where additional signals are produced by the transducer 102 for the vehicle passing the transducer 102. The process 200 may continue in a loop-wise manner to isolate channels having positive polarity signals indicative of wheels passing through the wheel gate while dynamically adjusting the detection threshold 312.

Figure 5A:
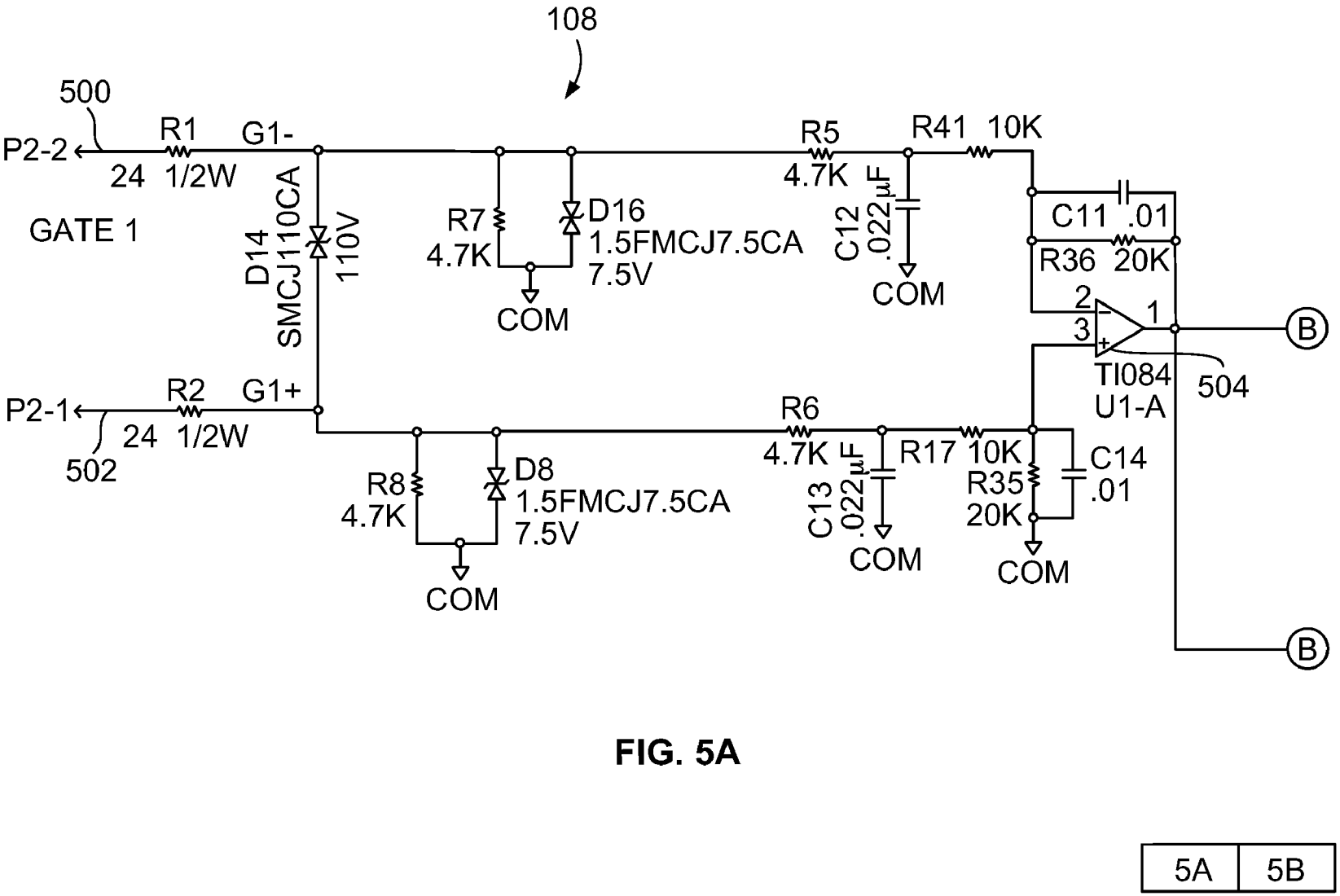
FIG. 5 is a schematic diagram of a portion of a Gate A circuit (shown in FIG. 1) in accordance with one embodiment.
Figure 5B:
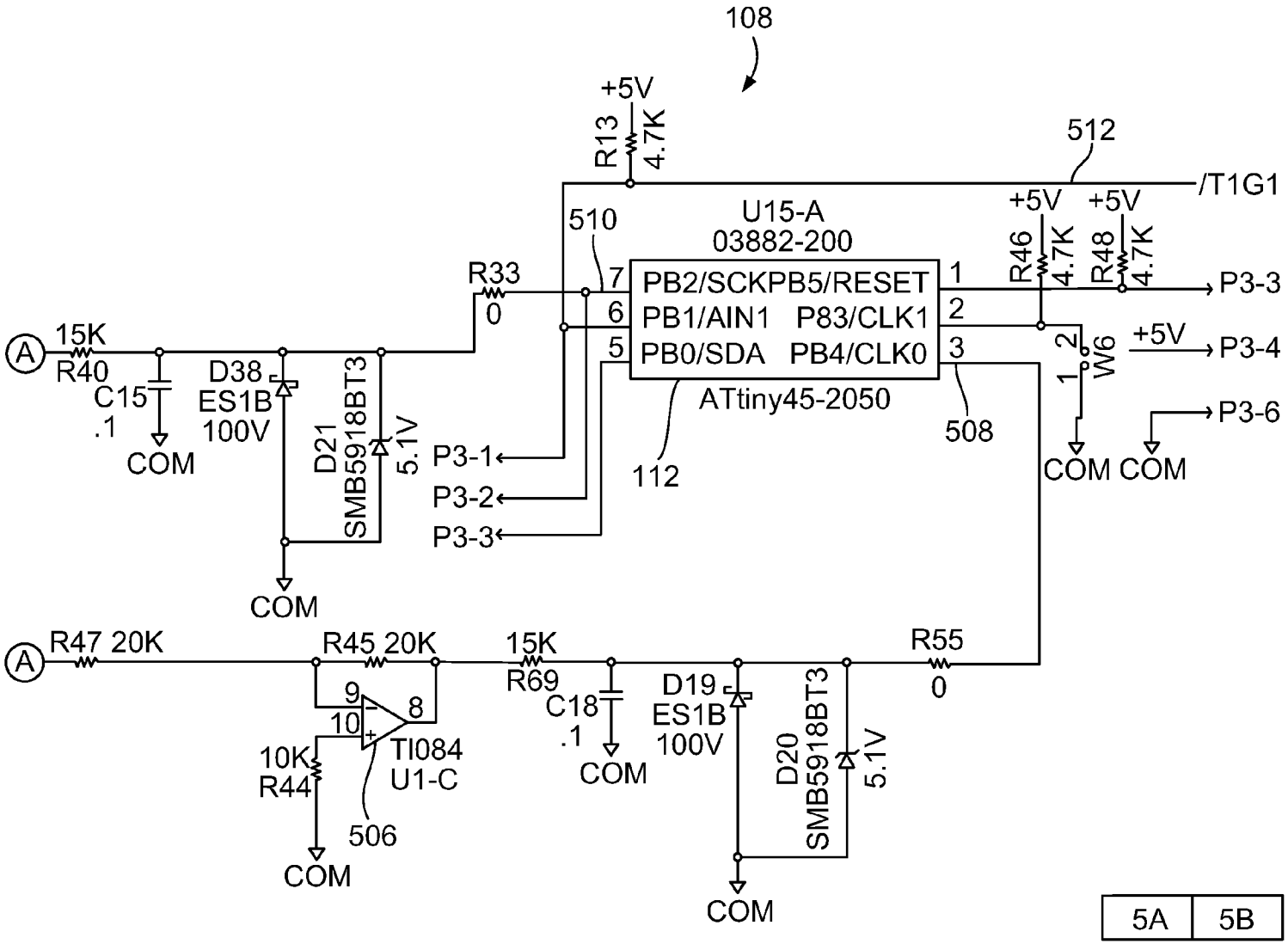

FIG. 5 is a schematic diagram of a portion of the Gate A circuit 108 in accordance with one embodiment. While the discussion herein focuses on the Gate A circuit 108, the description may apply to the Gate B circuit 110 (shown in FIG. 1). While several resistive, capacitive and other elements are shown and labeled accordingly in FIG. 5, one or more additional components may be added or removed to the circuitry.

A plurality of leads 500, 502 is electrically coupled with the transducer 102 (shown in FIG. 1). The leads 500, 502 may be wires, terminals, or other electrically conductive connections with a coil in the transducer 102, for example. The leads 500, 502 communicate the potential difference in the coil that is induced by the wheel passing through a magnetic field proximate the coil, as described above. The potential difference across the leads 500, 502 is communicated to a difference amplifier 504. The difference amplifier 504 receives the potential difference and produces a signal representative of the potential difference. For example, the difference amplifier 504 may generate a signal having a waveform similar to the second signal 300 (shown in FIG. 3). Alternatively, if the leads 500, 502 were installed or wired backwards, for example, the difference amplifier 504 may create a signal having a waveform similar to the second signal 400 (shown in FIG. 4). The difference amplifier 504 also may be a low pass filter that passes signals 300, 400 having a frequency below a predetermined threshold but blocks other signals from passing through the difference amplifier 504.

In one embodiment, the first signal 300 (shown in FIG. 3) communicated from the difference amplifier 504 to the microcontroller 112 over a first channel 510. The first signal 300 also is communicated from the difference amplifier 504 to an inverting amplifier 506. The inverting amplifier 506 changes the polarity of the received signal. For example, the inverting amplifier 506 may invert the first signal 300 in order to output the second signal 400 (shown in FIG. 4). The second signal 400 is communicated from the inverting amplifier 506 to the microcontroller 112 over a second channel 508. Alternatively, if the second signal 400 is output from the difference amplifier 504 to each of the microcontroller 112 and the inverting amplifier 506, then the inverting amplifier 506 inverts the second signal 400 to produce the first signal 300.

The microcontroller 112 samples the first and second signals 300, 400 over the first and second channels 510, 508, as described above. The microcontroller 112 performs one or more of the operations described above in connection with the process 200 (shown in FIG. 2) based on the first and second signals 300, 400 sampled over the terminals 508, 510. An output signal of the microcontroller 112 may be communicated to the processing unit 106 (shown in FIG. 1) using a third channel 512. For example, the microcontroller 112 may communicate the times at which the wheels are located or centered over the transducer 102 to the processing unit 106 in real time, or as the wheels pass the transducer 102. Alternatively, the processing unit 106 may include circuitry configured; to perform one or more of the operations of the process 200. For example, an analog-to-digital converter (not shown) may be disposed between the transducer 102 and the processing unit 106 to convert the analog signals output by the transducer 102 into digital signals for the processing unit 106. The processing unit 106 may analyze the digital signals in accordance with one or more embodiments described above in connection with the process 200.

Another embodiment relates to a rail vehicle inspection system. The inspection system comprises a wheel gate transducer and a gate circuit coupled with the wheel gate transducer. The wheel gate transducer is configured to generate a signal based on movement of a wheel of a rail vehicle relative to the wheel gate transducer. The gate circuit comprises a microcontroller; and is configured to receive the signal and to analyze a waveform of the signal in terms of waveform shape, waveform amplitude, and changes in waveform timing, for determining whether the signal is a true signal or a false signal. ("True signal" is defined as a signal generated by the wheel gate transducer in response to a wheel moving relative to the wheel gate transducer. "False signal" is defined as a signal generated by the wheel gate transducer that is unrelated to movement of a wheel relative to the gate transducer, such as resulting from low hanging objects on a rail vehicle, electromagnetic interference and other sources of signal interference, tampering, and the like.) The rail vehicle inspection system of this embodiment may be implemented using one or more of the techniques described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This, written description uses examples to disclose several embodiments of the invention, including the best mode, and also to enable any person skilled in the art to practice the embodiments of invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for identifying a location of a wheel of a rail vehicle, the method comprising:

producing with a wheel gate transducer a first signal representative of a potential difference between leads electrically coupled with the wheel gate transducer;

modifying the first signal received over a first channel to produce a second signal over a second channel, the second signal differing from the first signal; and monitoring the first and second signals over the first and second channels to identify the location of the wheel relative to the wheel gate transducer.

2. The method of claim 1, wherein the modifying operation comprises changing a polarity of the first signal to produce the second signal.

3. The method of claim 1, further comprising designating one of the first and second channels as a primary channel based on a polarity-based detection threshold, wherein the monitoring operation comprises sampling the first or second signal over the primary channel to identify the location of the wheel.

4. The method of claim 3, wherein the polarity-based detection threshold is based on a speed of the rail vehicle.

5. The method of claim 3, further comprising designating the other of the first and second channels as a secondary channel based on the polarity-based detection threshold, wherein the monitoring operation identifies the location of the wheel independent of the first or second signal communicated over the secondary channel.

6. The method of claim 3, wherein, prior to designating the one of the first and second channels as the primary channel, the first and second signals are sampled over the first and second channels at a predetermined initial sampling frequency and after designating the one of the first and second channels as the primary channel, the primary channel is sampled at a different sampling frequency.

7. The method of claim 1, further comprising examining a waveform of at least one of the first and second signals to determine if the signals represent the location of the wheel.

8. A rail vehicle inspection system comprising:

a wheel gate transducer configured to generate a potential difference based on movement of a wheel of a rail vehicle relative to the wheel gate transducer; and a gate circuit coupled with the wheel gate transducer and comprising a microcontroller, wherein the gate circuit is configured to receive the potential difference to produce a first signal representative of the potential difference over a first channel and to modify the first signal to produce a second signal over a second channel, further wherein the microcontroller is configured to monitor the first and second signals over the first and second channels to identify a location of the wheel relative to the wheel gate transducer.

9. The system of claim 8, wherein the gate circuit is configured to modify the first signal by changing a polarity of the first signal to produce the second signal.

10. The system of claim 8, wherein the microcontroller is configured to:

designate one of the first and second channels as a primary channel based on a polarity-based detection threshold; and sample the first or second signal over the primary channel to identify the location of the wheel.

11. The system of claim 10, wherein the polarity-based detection threshold is based on a speed of the rail vehicle.

12. The system of claim 10, wherein the microcontroller is configured to: designate the other of the first and second channels as a secondary channel based on the polarity-based detection threshold; and identify the location of the wheel independent of the first or second signal communicated over the secondary channel.

13. The system of claim 10, wherein, prior to designating the one of the first and second channels as the primary channel, the microcontroller is configured to sample the first and second signals over the first and second channels at a predetermined initial sampling frequency and, after designating the one of the first and second channels as the primary channel, the microcontroller is configured to sample the primary channel at a different sampling frequency.

14. The system of claim 8, wherein the microcontroller is configured to examine a waveform of at least one of the first and second signals to determine if the signals represent the location of the wheel.

15. A non-transitory computer readable storage medium for a wheel detection system having a wheel gate transducer and a gate circuit including a microcontroller, the computer readable storage medium comprising:

instructions to direct the gate circuit to:

produce a first signal representative of a potential difference between leads electrically coupled with the wheel gate transducer; and modify the first signal received over a first channel to produce a second signal over a second channel, the second signal differing from the first signal; and instructions to direct the microcontroller to monitor the first and second signals over the first and second channels to identify the location of the wheel relative to the wheel gate transducer.

16. The non-transitory computer readable storage medium of claim 15, wherein the instructions direct the gate circuit to modify the first signal by comprises changing a polarity of the first signal to produce the second signal.

17. The non-transitory computer readable storage medium of claim 15, wherein the instructions direct the microcontroller to:

designate one of the first and second channels as a primary channel based on a polarity-based detection threshold; and sample the first or second signal over the primary channel to identify the location of the wheel.

18. The non-transitory computer readable storage medium of claim 17, wherein the instructions direct the microcontroller to:

designate the other of the first and second channels as a secondary channel based on the polarity-based detection threshold; and identify the location of the wheel independent of the first or second signal communicated over the secondary channel.

19. The non-transitory computer readable storage medium of claim 17, wherein, prior to designating the one of the first and second channels as the primary channel, the instructions direct the microcontroller to sample the first and second signals over the first and second channels at a predetermined initial sampling frequency and, after designating the one of the first and second channels as the primary channel, the instructions direct the microcontroller to sample the primary channel at a different sampling frequency.

20. The non-transitory computer readable storage medium of claim 15, wherein the instructions direct the microcontroller to examine a waveform of at least one of the first and second signals received over the primary channel to determine if the signals represent the location of the wheel.

21. A rail vehicle inspection system comprising:

a wheel gate transducer configured to generate a first signal and a second signal that is a modification of the first signal, based on movement of a wheel of a rail vehicle relative to the wheel gate transducer; and a gate circuit coupled with the wheel gate transducer and comprising a microcontroller, wherein the gate circuit is configured to receive the signals and to analyze a waveform of at least one of the signal in terms of one or more of waveform shape, waveform amplitude, and changes in waveform timing for determining whether the signal is a true signal or a false signal.

* * * * *